US009890347B2

(12) United States Patent
Delbridge et al.

(10) Patent No.: US 9,890,347 B2
(45) **Date of Patent: *Feb. 13, 2018**

(54) ASHLESS OR REDUCED ASH QUATERNARY DETERGENTS

(71) Applicant: The Lubrizol Corporation, Wickliffe, OH (US)

(72) Inventors: Ewan E. Delbridge, Concord Township, OH (US); Virginia A. Carrick, Chardon, OH (US); John K. Pudelski, Cleveland Heights, OH (US); Matthew D. Giesleman, Wickliffe, OH (US); Christopher L. Friend, Nottingham (GB); Patrick E. Mosier, Bay Village, OH (US); Michele M. Rogers, Chagrin Falls, OH (US); Mark T. Tierney, Wayland, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/288,839

(22) Filed: Oct. 7, 2016

(65) Prior Publication Data

US 2017/0022444 A1 Jan. 26, 2017

Related U.S. Application Data

(60) Continuation of application No. 14/277,079, filed on May 14, 2014, now Pat. No. 9,469,824, which is a (Continued)

(51) Int. Cl.
*C10M 133/04* (2006.01)
*C10M 159/12* (2006.01)
(Continued)

(52) U.S. Cl.
CPC ..... *C10M 159/12* (2013.01); *C10M 133/06* (2013.01); *C10M 133/40* (2013.01); *C10M 133/46* (2013.01); *C10M 135/10* (2013.01); *C10M 137/12* (2013.01); *C10M 159/22* (2013.01); *C10M 159/24* (2013.01); *C10M 125/00* (2013.01); *C10M 125/20* (2013.01); *C10M 125/22* (2013.01); *C10M 125/24* (2013.01); *C10M 125/26* (2013.01); *C10M 129/04* (2013.01); *C10M 129/10* (2013.01); *C10M 129/26* (2013.01); *C10M 129/54* (2013.01); *C10M 129/88* (2013.01); *C10M 129/92* (2013.01); *C10M 129/95* (2013.01); *C10M 133/04* (2013.01); *C10M 133/08* (2013.01); *C10M 133/30* (2013.01); *C10M 135/08* (2013.01); *C10M 137/00* (2013.01); *C10M 137/08* (2013.01); *C10M 137/14* (2013.01); *C10M 169/04* (2013.01); *C10M 2201/00* (2013.01); *C10M 2201/061* (2013.01); *C10M 2201/062* (2013.01); *C10M 2201/082* (2013.01); *C10M 2201/084* (2013.01); *C10M 2201/085* (2013.01); *C10M 2203/1025* (2013.01); *C10M 2205/028* (2013.01); *C10M 2207/02* (2013.01); *C10M 2207/023* (2013.01); *C10M 2207/024* (2013.01); *C10M 2207/027* (2013.01); *C10M 2207/028* (2013.01); *C10M 2207/08* (2013.01); *C10M 2207/10* (2013.01); *C10M 2207/123* (2013.01); *C10M 2207/126* (2013.01); *C10M 2207/144* (2013.01); *C10M 2207/26* (2013.01); *C10M 2207/262* (2013.01); *C10M 2207/28* (2013.01); *C10M 2215/02* (2013.01); *C10M 2215/04* (2013.01); *C10M 2215/042* (2013.01); *C10M 2215/06* (2013.01); *C10M 2215/20* (2013.01); *C10M 2215/221* (2013.01); *C10M 2215/224* (2013.01); *C10M 2215/28* (2013.01); *C10M 2219/04* (2013.01); *C10M 2219/044* (2013.01); *C10M 2219/046* (2013.01); *C10M 2223/02* (2013.01); *C10M 2223/045* (2013.01); *C10M 2223/08* (2013.01); *C10M 2227/061* (2013.01);
(Continued)

(58) Field of Classification Search
CPC ..... C10M 133/04; C10M 2215/02; C10M 129/10; C10M 129/26; C10M 129/54; C10M 129/92; C10M 129/95; C10M 135/10; C10M 137/00; C10M 137/12; C10M 137/14; C10M 169/04; C10M 2207/023; C10M 2207/10; C10M 2207/144; C10M 2207/26; C10M 2207/262; C10M 2207/28; C10M 2219/044; C10M 2219/046; C10N 2220/04
See application file for complete search history.

(56) References Cited

U.S. PATENT DOCUMENTS 3,362,801 A 1/1968 Fareri et al.
3,962,104 A 6/1976 Swietlik et al.
(Continued)

*Primary Examiner* — Taiwo Oladapo

(74) *Attorney, Agent, or Firm* — Christopher D. Hilker; David M. Shold; Michael A. Miller

(57) ABSTRACT

A composition of an oil-soluble ionic detergent that does not contribute metal ions to the composition, and which comprises a quaternary non-metallic pnictogen cation and an organic anion having at least one hydrocarbyl group of sufficient length to impart oil solubility to the detergent, the detergent having a total base number (TBN) to total acid number (TAN) ratio of at least 2:1 imparts ash-free basicity to a lubricant composition.

11 Claims, No Drawings

Related U.S. Application Data division of application No. 13/203,852, filed as application No. PCT/US2010/025714 on Mar. 1, 2010, now Pat. No. 8,765,650.

(60) Provisional application No. 61/156,981, filed on Mar. 3, 2009.

(51) Int. Cl.

| | |
|---|---|
| ***C10M 133/06*** | (2006.01) |
| ***C10M 135/10*** | (2006.01) |
| ***C10M 137/12*** | (2006.01) |
| ***C10M 159/22*** | (2006.01) |
| ***C10M 159/24*** | (2006.01) |
| ***C10M 133/40*** | (2006.01) |
| ***C10M 133/46*** | (2006.01) |
| *C10M 129/95* | (2006.01) |
| *C10M 169/04* | (2006.01) |
| *C10M 129/92* | (2006.01) |
| *C10M 137/00* | (2006.01) |
| *C10M 129/54* | (2006.01) |
| *C10M 129/10* | (2006.01) |
| *C10M 129/26* | (2006.01) |
| *C10M 129/04* | (2006.01) |
| *C10M 133/08* | (2006.01) |
| *C10M 125/22* | (2006.01) |
| *C10M 125/20* | (2006.01) |
| *C10M 129/88* | (2006.01) |
| *C10M 125/26* | (2006.01) |
| *C10M 125/24* | (2006.01) |
| *C10M 133/30* | (2006.01) |
| *C10M 137/08* | (2006.01) |
| *C10M 135/08* | (2006.01) |
| *C10M 125/00* | (2006.01) |
| *C10M 137/14* | (2006.01) |

(52) U.S. Cl.

CPC ..... *C10N 2220/04* (2013.01); *C10N 2230/04* (2013.01); *C10N 2230/42* (2013.01); *C10N 2230/43* (2013.01); *C10N 2230/45* (2013.01); *C10N 2230/52* (2013.01); *C10N 2240/10* (2013.01)

(56) References Cited

U.S. PATENT DOCUMENTS

| | | | | |
|---|---|---|---|---|
| 4,248,719 | A * | 2/1981 | Chafetz | C07D 207/412 508/293 |
| 5,531,911 | A | 7/1996 | Adams et al. | |
| 5,688,751 | A | 11/1997 | Cleveland et al. | |
| 5,827,805 | A | 10/1998 | Adams et al. | |
| 8,765,650 | B2 * | 7/2014 | Delbridge | C10M 133/06 508/547 |
| 9,109,184 | B2 * | 8/2015 | Delbridge | C10M 133/06 |
| 2004/0214729 | A1 * | 10/2004 | Buitrago | C10M 141/10 508/272 |
| 2005/0070447 | A1 | 3/2005 | Barnes et al. | |
| 2006/0116297 | A1 * | 6/2006 | Basar | C10M 169/04 508/287 |
| 2006/0247140 | A1 | 11/2006 | Cressey et al. | |
| 2008/0052985 | A1 | 3/2008 | Stevenson et al. | |
| 2008/0114105 | A1 | 5/2008 | Hell et al. | |
| 2008/0307698 | A1 | 12/2008 | Barton et al. | |
| 2009/0029887 | A1 | 1/2009 | Schwab et al. | |
| 2009/0093384 | A1 | 4/2009 | Ward et al. | |

* cited by examiner

ASHLESS OR REDUCED ASH QUATERNARY DETERGENTS

BACKGROUND OF THE INVENTION

The disclosed technology relates to a lubricant additive component for internal combustion engines, having no or low ash but high basicity.

The formulation of engine oils which contain reduced metal content (expressed as sulfated ash, ASTM D 874) but sufficient basicity (expressed as Total Base Number, TBN, ASTM D 2896) to adequately neutralize acidic combustion products while continuing to provide good protection to engine components has remained elusive. Low ash is desirable to minimize fouling of catalysts and other pollution control devices in the exhaust stream, which may be caused by migration of metal ions from the lubricant into the exhaust system. Metal containing detergents, however, and especially overbased metal-containing detergents, have long been a key to protecting engine parts from attack by acidic exhaust components that may enter the lubricant system by piston ring blow-by. It is desirable to attain these seemingly contradictory goals while still providing excellent lubrication and protection to the engine.

There have been many attempts to design overbased detergents. For example, U.S. Pat. No. 5,827,805, Adams et al., Oct. 27, 1998, discloses a salt represented by the structure

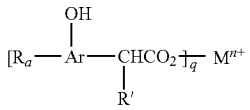

where Ar is an aromatic group, each R is independently a hydrocarbyl or substituted hydrocarbyl group, at least one R group having at least 8 carbon atoms, a is 1 to 4, R' is hydrogen or alkyl, $M^{n+}$ is a quaternary ammonium ion or a metal ion of valence n, and q is a number up to n. The salts can be neutral salts, partially neutralized salts, or overbased salts. The overbased materials are prepared by reacting an acidic material with a mixture comprising the initial lactone or carboxylic acid product, a stoichiometric excess of a metal base, and a promoter. The compositions disclosed are useful as lubricant and fuel additives.

U.S. Patent Application Publication 2006/0247140, Cressey et al., Nov. 2, 2006, discloses a sulphur free reaction product of a hydrocarbyl substituted aromatic compound containing an acidic group and an organic nitrogen-containing base reacted with the acidic group. The organic nitrogen-containing base may be, among other materials, a tetraalkylammonium salt. It is said to be advantageous to use a strong organic nitrogen-containing base such as tetraalkylammonium hydroxide to neutralize an oligomeric reaction product prepared by reacting an alkylphenol such as dodecylphenol and an aldehyde such as formaldehyde. The compositions disclosed are said to be useful in a method for lubricating an internal combustion engine.

U.S. Pat. No. 3,962,104, Swietlik et al., Jun. 8, 1976, discloses lubricating oils containing as an ashless detergent a quaternary ammonium salt derived from an organic acid and a cation obtained by the reaction of a tertiary amine, olefin oxide and water. The quaternary ammonium hydroxides are disclosed as

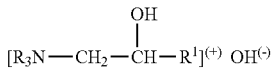

Tertiary amines which are suitable include, among others, amines of the formula $R^1R^2R^3N$ such as, among others, trimethyl amine; or pyridine and substituted pyridines. The organic acids include, among others, carboxylic acids, phenols, sulphurized phenols, and sulphonic acids.

U.S. Pat. No. 5,688,751, Cleveland et al., Nov. 18, 1977, discloses salicylate salts as lubricant additives for two-cycle engines. The salt of the salicylic acid may be a basic metal salt, also known as an overbased salt. The hydroxyaromatic carboxylic compound can also be in the form of an ammonium salt or a hydrocarbylamine salt (i.e., a quaternary nitrogen salt). Appropriate amines can by hydrocarbyl primary, secondary, or tertiary amines.

PCT Publication WO 2008/075016, Jun. 26, 2008, discloses a nonaqueous lubricating oil composition comprising a major amount of abase oil and a minor amount of an additive which is a salt of general formula $C^+A^-$, with the cation, $C^+$, being a quaternary phosphonium or quaternary ammonium ion having four hydrocarbyl groups. The anions may be of the general formula $[R^1R^2P(O)O]^-$ or sulfosuccinate esters or carboxylate anions.

PCT Publication WO 2006/135881, Dec. 21, 2006, discloses a quaternary ammonium salt detergent for use in fuels. The quaternary ammonium salt is the reaction product of (a) a hydrocarbyl-substituted acylating agent and a compound having an oxygen or nitrogen atom capable of condensing with said acylating agent and further having a tertiary amino group; and (b) a quaternizing agent suitable for converting the tertiary amino group to a quaternary nitrogen.

U.S. Pat. No. 5,531,911, Adams et al., Jul. 2, 1996, discloses functional fluids such as lubricants comprising the reaction product of an amine and a sulfonic acid as an anti-rust agent. The sulfonic acid may include mono-, di-, and tri-alkylated benzene and naphthalene sulfonic acids. The amines include primary, secondary, and tertiary amines. A particularly useful product is the ethylenediamine salt of dinonylnaphthalenesulfonic acid.

European Patent EP 0 727 477 B, Mar. 14, 2001, discloses ash-free detergents in lubricating oils. Calixarenes are used to complex a moiety derived from an organic nitrogen-containing base, typically a guanidine or ammonium, preferably a guanidine salt.

U.S. Pat. No. 3,362,801, Fareri et al., Jan. 9, 1968, discloses hydrocarbon oil composition containing alkyl quaternary ammonium salicylates. The hydrocarbon oil may be a fuel oil blend.

The disclosed technology, therefore, solves certain of the above-identified problems by employing a quaternary pnictogen detergent.

SUMMARY OF THE INVENTION

The disclosed technology provides a composition comprising an oil-soluble ionic detergent, which detergent may be substantially free from acidic protons, which does not contribute metal ions to the composition, and which comprises (a) a quaternary non-metallic pnictogen cation and (b) an organic anion having at least one hydrocarbyl group of sufficient length to impart oil solubility to the detergent; said ionic detergent having a total base number (TBN) to total acid number (TAN) ratio of at least 2:1.

The disclosed technology also provides a composition comprising an oil-soluble ionic detergent, which detergent comprises (a) a quaternary non-metallic pnictogen cation and (b) an organic anion having at least one aliphatic hydrocarbyl group of sufficient length to impart oil solubility to the detergent; said oil-soluble ionic detergent having a total base number (TBN) to total acid number (TAN) ratio of at least 2:1; wherein said oil-soluble ionic detergent exhibits a TBN of at least 10 arising from a non-metallic base.

The disclosed technology further provides a composition comprising an oil-soluble ionic detergent, which detergent is substantially free from acidic protons and which comprises (a) a quaternary non-metallic pnictogen cation and (b) an organic anion having at least one hydrocarbyl group of sufficient length to impart oil solubility to the detergent; said ionic detergent having a total base number (TBN) to total acid number (TAN) ratio of at least 2:1; wherein said ionic detergent exhibits a TBN of at least 50 arising from a non-metallic base.

In another aspect, the technology provides a method for preparing an oil-soluble ionic detergent, comprising the steps of (a) providing an oil-soluble acidic substrate, optionally in an organic solvent and optionally in the presence of a $C_1$ to $C_6$ alcohol; (b) admixing with said acidic substrate a molar excess of a basic compound comprising a quaternary ammonium compound or a quaternary phosphonium compound; and (c) optionally reacting the resulting mixture with an oxo-acid.

In another aspect, the technology provides a method for preparing an oil-soluble ionic detergent, comprising the steps of: (a) reacting a tertiary amine with a dihydrocarbyl carbonate to form a quaternary ammonium carbonate; and (b) reacting the quaternary ammonium carbonate with an oil-soluble acidic substrate having at least one aliphatic hydrocarbyl group of sufficient length to impart oil solubility to the detergent.

And in yet another aspect, the technology provides a method for preparing an, oil-soluble ionic detergent, comprising the steps of (a) providing a metal salt of an oil-soluble acidic substrate, optionally in an organic solvent and optionally in the presence of a C1 to C6 alcohol; and (b) admixing with said metal salt a quaternary pnictogen halide compound.

In yet another aspect, the technology provides a method for preparing an oil-soluble ionic detergent comprising the steps of: (a) mixing together a tertiary amine, an alkylene oxide, and an oil-soluble acidic compound, and (b) heating the resulting mixture to effect reaction among the components of (a).

DETAILED DESCRIPTION OF THE INVENTION

Various preferred features and embodiments will be described below by way of non-limiting illustration.

One component of the disclosed technology comprises an oil-soluble ionic detergent which, in itself, does not contribute metal ions to the composition or which, alternatively, contributes a lesser quantity of metal ions to the composition than would normally be indicated by the extent of basicity of the detergent. Most conventional detergents used in the field of engine lubrication, unlike those of the present technology, obtain most or all of their basicity or TBN from the presence of basic metal compounds (metal hydroxides, oxides, or carbonates, typically based on such metals as calcium, magnesium, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid such as carbon dioxide or a lower carboxylic acid) with a mixture of an acidic organic compound (also referred to as a substrate), a stoichiometric excess of a metal base, typically in a reaction medium of an one inert, organic solvent (e.g., mineral oil, naphtha, toluene, xylene) for the acidic organic substrate. Optionally a small amount of promoter such as a phenol or alcohol is present. The acidic organic substrate will normally have a sufficient number of carbon atoms to provide a degree of solubility in oil.

Such conventional overbased materials and their methods or preparation are well known to those skilled in the art. Patents describing techniques for making basic metallic salts of sulfonic acids (e.g., hydrocarbyl-substituted benzenesulfonic acids), carboxylic acids (e.g., stearic acid and other long-chain fatty acids, hydrocarbyl-substituted succinic acid, hydrocarbyl-substituted salicylic acids), phenols (including hydrocarbyl-substituted sulfur- or methylene-bridged phenols of both linear or cyclic geometry, the latter also being referred to as calixarenes), phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents (based on salixarenes) are described in U.S. Pat. No. 6,200,936 and PCT Publication WO 01/56968. Saligenin detergents are described in U.S. Pat. No. 6,310,009. Any of these types of acids or substrates may also be used in the presently disclosed technology.

The detergents of the present technology differ from conventional metal-based detergents in that they are metal free or substantially metal free or contain a lower amount of metal that would be expected based on the amount of TBN that they deliver. Alternatively expressed, they do not contribute metal ions to lubricants in which they are added, or contribute less metal ions than would be expected on the amount of TBN that they deliver. In certain embodiments the detergents are metal free, although they may be mixed with other components, such as other detergents that do contain metal, while still, in themselves, being metal free. By the term "substantially metal free" is meant a detergent that contains only a contaminant or a trace amount of a metal, an amount that may in many circumstances be ignored. For instance, such a detergent may contain less than 5% or less than 3 or 1% metal by weight.

In place of some or all of the metal ion of the detergent, the materials of the present invention will contain one or more quaternary non-metallic pnictogen cations. Pnictogens (the term being derived from Greek pnigein, to choke or stifle) are the elements in column 15 (or Va) of the periodic table, the column headed by nitrogen. The non-metallic pnictogens include nitrogen and phosphorus.

Quaternary nitrogen or phosphorus compounds are known. Ordinarily nitrogen is a trivalent element, forming three covalent bonds to hydrogen or carbon atoms in ammonia or amines: $NH_xR_{3-x}$, where R is a group linked to the nitrogen atom through a carbon atom of the R group. Quaternary nitrogen compounds, on the other hand, comprise a quaternary ammonium ion and a counterion (e.g., hydroxide, halide), represented by the general formula $NR_4^+$ $X^-$. Quaternary phosphonium ions may be similarly represented. In such materials, the nitrogen (or phosphorus) has four substantially non-ionizable covalent bonds to carbon atoms. The quaternary atoms are permanently charged and are comparatively unaffected by the pH of the medium. They are thus distinguished from ordinary ammonium or phosphonium ions or protonated amines, which materials contain up to three substantially non-ionizable covalent bonds to carbon and one or more acidic hydrogen atoms or protons associated with the nitrogen or phosphorus atom. The present quaternary ions will not contribute acidity to the detergent, as would be titratable as TAN by ASTM D 664A. The ionic detergents of the present technology will thus be free from acidic protons in the sense that they will have the general structure $NR_4^+X^-$ rather than $HNR_3^+X^-$, in the case of nitrogen. However, the detergent molecules overall may (or may not) contain other acidic hydrogen that is titratable as TAN, on other portions of the detergent than the cation, that is, on the anionic substrate portion. An example of a titratable hydrogen might be on a phenolic OH group. In certain embodiments, however, the detergent as a whole will be substantially free from acidic protons, having a TAN of less than 10 or less than 5 or less than 3 or less than 1, on an oil free basis.

It is not intended that each of the four bonds of the nitrogen or phosphorus must necessarily be directed to a separate carbon atom: The 4 R groups are not necessary different carbon groups. Thus two of the bonds may be directed to the same carbon atom in a double-bonded structure or as delocalized bonds within an aromatic ring. Examples of such include pyridinium ions and imidazolium ions, such as

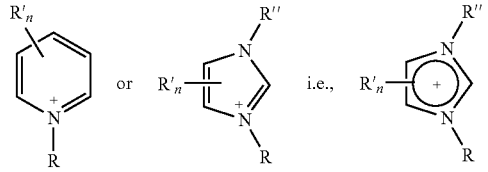

where R, R' and R" are hydrocarbyl groups (substitution on the ring carbon atoms being optional). Such species may optionally be included within the present use of the term "quaternary," since the quaternary atom therein has four bonds to carbon atoms.

Many quaternary salt compounds are known. Quaternary ammonium salts, for instance, are commercially available and may be prepared by the reaction of ammonia or an amine with an alkyl halide as the complete alkylation product. Certain quaternary phosphonium salts may be prepared by the reaction of phosphine with aldehydes, e.g., tetrakis(hydroxymethyl)phosphonium chloride. Examples of quaternary ammonium compounds include tetrahydrocarbyl ammonium salts with hydrocarbyl groups such as methyl, ethyl, propyl, butyl, benzyl, and mixtures thereof. In another embodiment, up to three of the R groups in the quaternary $NR_4^+$ structure may be such hydrocarbyl groups and one or more groups may be a hydroxy-substituted hydrocarbyl group such as a hydroxyalkyl group, or an amine-substituted hydrocarbyl group. Examples of quaternary ammonium salts containing a hydroxyalkyl group, and methods for their synthesis, are disclosed in U.S. Pat. No. 3,962,104, Swietlik et al.; see column 1 line 16 through column 2 line 49; column 8 lines 13 through 49, and the Examples. In certain embodiments, the quaternary ammonium compound is derived from a monoamine, i.e, a tertiary amine having only a single amino group, that is, having no additional amine nitrogen atoms in any of the three hydrocarbyl groups or substituted hydrocarbyl groups attached to the tertiary amine nitrogen. In certain embodiments there are no additional amine nitrogen atoms in any of the hydrocarbyl groups or substituted hydrocarbyl groups attached to the central nitrogen in the quaternary ammonium ion. Further examples of quaternary ammonium compounds include tetraethylammonium hydroxide or halide and tetrabutylammonium hydroxide or halide and such biological materials as choline chloride, $HOCH_2CH_2N(CH_3)_3Cl$. Any such materials may provide the cation for the present detergents.

The detergents of the present technology will contain a quaternary pnictogen cation, along with optionally a metal cation. The anion portion of the detergent will be an organic anion having at least one aliphatic hydrocarbyl group of sufficient length to impart oil solubility to the detergent. (As used herein, the term "aliphatic" is intended to encompass "alicyclic." That is, the aliphatic hydrocarbyl groups may be linear, branched, or cyclic or may contain carboxylic moieties, but are to be distinguished from "aromatic" groups, which are not to be considered "aliphatic.") Suitable aliphatic hydrocarbyl groups, if they are in the form of a substituent on an aromatic ring (as in alkylphenates or alkylbenzenesulfonates) may contain 4 to 400 carbon atoms, or 6 to 80 or 6 to 30 or 8 to 25 or 8 to 15 carbon atoms. The anionic portion of the detergent may thus be any of the anions derived from the acidic organic materials that are used to prepare conventional detergents. As mentioned above, these include sulfonic acids, providing sulfonate detergents with sulfonate anions, carboxylic acids, providing carboxylate detergents with carboxylate anions, phenols, providing phenate detergents with phenate anions, hydrocarbyl-substituted salicylic acids, providing salicylate detergents with salicylate anions, phosphonic acids, providing phosphonate detergents, as well as salixarate, calixarate, and saligenin detergents, and mixtures thereof. In certain embodiments the ionic detergents may be sulfonates or salicylates, and in other embodiments, sulfonates.

The ionic detergents of the present technology will be characterized by having ratio of a total base number (TBN) to total acid number (TAN) of at least 2:1. The TBN:TAN ratio may also be 7:1 to 150:1 or to 300:1 or greater, or 10:1 to 70:1. If the TAN is zero, the resulting ratio is also to be considered to be greater than 2:1. That is, the detergent will have relatively little acidity, such as may be provided by acidic protons, such as a TAN typically of less than 10 or less than 5 or 2 or 1. The detergent will also have a relatively large amount of basicity. The TBN of the detergent may be, for example, at least 10 or at least 30 or 50 to 300 or 70 to 210 or 100 to 150 (each presented on a neat chemical basis, absent oil dilution). The basicity of a metal detergent is also sometimes expressed in terms of metal ratio, which refers to the ratio of the total equivalents of the metal to the equivalents of the acidic organic compound or substrate. A neutral metal salt has a metal ratio of one. A salt having 4.5 times as much metal as present in a normal salt will have metal excess of 3.5 equivalents, or a ratio of 4.5, and so on. In the case of the detergents of the present technology, which may be substantially free from metal salts, the corresponding concept may be expressed as "base ratio." The basic salts of the present invention may thus, in certain embodiments, have a base ratio of 1.5 or 2 or 3 or 7, up to 40 or 25 or 20 or 10. That is, in certain embodiments the materials may comprise a stoichiometric excess of quaternary non-metallic pnictogen cations over the organic anions such that said cations and anions are present in an equivalent ratio of at least 2:1, which is to say to a base ratio of at least 2.0. Alternatively, in certain embodiments the materials of the present technology may have little or no stoichiometric excess of quaternary non-metallic pnictogen cations.

Such high TBN values may be obtained by a process analogous to overbasing of the ionic detergent. The process for preparing overbased metal-containing detergents is known, as described above, and the process for preparing the present materials may be understood by reference thereto, while considering the important differences required to obtain the present materials. That is, the present detergents may be prepared by reacting a mixture comprising an acidic organic compound or substrate, as described above, with a molar excess, that is, a stoichiometric excess, of a basic quaternary pnictogen compound, optionally in an inert reaction medium or organic solvent such as mineral oil, naphtha, toluene, or xylene. Optionally an additional acidic material may be present, such as oxo acid, e.g., carbon dioxide, to form a carbonate or bicarbonate, and optionally a small amount of a promoter (e.g. an alkanol of one to twelve or one to six carbon atoms such as methanol, ethanol, or amyl alcohol, or an alkylated an alkylated phenol such as heptylphenol, octylphenol, or nonylphenols) may be present.

The presence of the oxo acid may assist in incorporation of larger quantities of base, through formation of, in the case of carbon dioxide, colloidal carbonate of the base. Suitable oxo anions which may become a part of the overbased detergent include carbonate, bicarbonate, borate, hydroxide, nitrate, phosphate, sulfate, and carboxylate, such as oxalate, tartrate, phenate, citrate, benzoate, succinate, and acetate ions. The carboxylate anions may contain 8 or fewer or 6 or fewer or 5 or fewer or 3 or 2 or 1 carbon atom(s). Also included may be ions derived from β-keto esters and diketones. The oxo anions may be derived from inorganic acids, e.g., carbonate or bicarbonate ions.

In one embodiment, the ionic detergent of the present technology may be prepared by reacting the acidic organic compound, i.e., substrate, with an excess of a basic quaternary pnictogen compound in the substantial absence of a basic metal compound, so as to provide a substantially metal-free detergent. In another embodiment, the acidic organic compound, i.e., substrate, may be reacted with an excess of a basic metal compound and a basic quaternary pnictogen compound, reacted simultaneously as a mixture, or sequentially, in any order, so as to prepare an ionic detergent that is not metal free but rather has a metal content that is reduced in proportion to the amount of the quaternary pnictogen material that is present. Also, the substrates of the quaternary ammonium salts, (e.g., salicylates, sulfonates), whether neutral or basic, may be overbased with metal bases such as $Ca(OH)_2$ or MgO in the presence of $CO_2$ and suitable known overbasing promoters or solvents. Any such materials may have, for instance, 10 to 90% or 25% or 50% or 75% of the metal content that would normally be present based on its TBN.

In one embodiment, an ionic detergent of the present technology may be prepared by providing a metal salt of an oil-soluble acidic substrate of the type described above, optionally in an organic solvent and optionally in the presence of a C1 to C6 alcohol and admixing with said metal salt a quaternary pnictogen halide compound. In certain embodiments the halide may be bromide or chloride, and in one embodiment the halide may be chloride. This reaction may be described as a metathesis reaction, in which the metal-containing organic salt is reacted with the quaternary pnictogen halide to form the quaternary pnictogen organic salt and the metal halide. In this instance, the originally present metal may be retained in the product or it may be removed (e.g., by filtration of metal halide) to provide a product with reduced metal content, as in the above paragraph. If substantially all the metal is removed (or is not present from the initial synthesis), the product may be substantially metal free.

The quaternary pnictogen halide compound may be a commercially available material, or it may be prepared by reaction of a tertiary amine with a hydrocarbyl halide, by known techniques. This reaction may be done in a separate vessel or in the same vessel in which it is subsequently (or simultaneously) reacted with the oil-soluble acidic compound, which may be converted previously (or simultaneously) into its metal neutralized form. This may be represented by the following general reaction scheme:

$$NR_3+R—X \rightarrow NR_4^+X^-;NR_4^+X^-+H\text{-}A+MOH \rightarrow NR_4^+A^-+MX$$

where the Rs represents hydrocarbyl or substituted hydrocarbyl groups, which may be the same or different, X represents a halogen or halide, M represents a metal (without regard to its valence) such as Na, and $A^-$ represents the anionic portion of the oil-soluble acid substrate. One advantage of this method of preparing the quaternary detergent is that the use of a benzyl halide or substituted benzyl halide, such as benzyl chloride, as the alkylating agent R—X permits preparation of quaternary ammonium detergents prepared from amines of low nucleophilicity which could not be readily quaternized by other methods.

A neutral or overbased quaternary ammonium detergent may also be prepared by an alternative process in which a tertiary amine is reacted with a dihydrocarbyl carbonate, such as a dialkyl carbonate or a dibenzyl carbonate to form an intermediate quaternary ammonium carbonate, as shown:

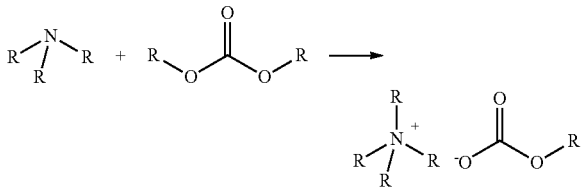

where each R is independently a hydrocarbyl group (which may be the same or different). The carbonate used may be, for instance, methyl carbonate or benzyl carbonate. Reaction of the intermediate quaternary carbonate with an acidic organic compound (that is, an oil-soluble acidic substrate having at least one aliphatic hydrocarbyl group of sufficient length to impart oil solubility to the detergent) will generate the quaternary detergent by simple proton transfer from the acidic compound, releasing $CO_2$ and an alcohol ROH, both of which may be removed if desired.

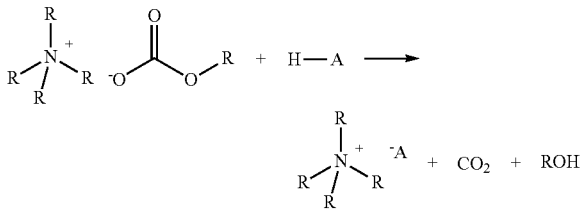

Moreover, the quaternary ammonium carbonate intermediate may be employed in stoichiometric excess relative to the detergent substrate, facilitating the synthesis of ashless overbased detergents (with base ratio>1.0). That is, the quaternary ammonium carbonate may be reacted with less than 1 equivalent of the oil-soluble acidic substrate. The detergent substrate may be derived from any of the acidic organic compounds disclosed herein for preparing detergents, to make detergents including carboxylate, sulfonate, phenate, salicylate, salixarate, and saligenin detergents. By an analogous process, quaternary phosphonium detergents may likewise be prepared.

The resulting detergent may be reacted with additional basic material, whether of a quaternary pnictogen base or a metal base, to increase its TBN, as described in further detail above. The detergent may be prepared entirely free of metal ions or it may contain a portion of metal ions along with the quaternary ammonium (pnictogen) ions, for example, by additional treatment with a basic metal compound, as described in greater detail above. Such further treated materials may optionally be reacted with an oxo-acid, as described above.

A neutral quaternary ammonium detergent may also be prepared by yet another alternative process. It is known that quaternization of a tertiary amine may be effected by reaction with an olefin oxide. In the instant process, however, this quaternization reaction may be conducted simultaneously with reaction with the acidic organic compound (substrate), in a "one-step" process. By "simultaneously" is meant mixing the three components, typically in a single vessel, and permitting them to react without any isolation or purification of intermediates and without intentionally reacting the amine and the olefin oxide to substantial completion before addition of the acidic organic compound. The reaction may occur in the presence or absence of solvent and in the presence or absence of diluent oil. In one embodiment, an amount of diluent oil is present that conventionally accompanies one or more of the reactants. For instance, the acidic organic compound may be supplied mixed with 10 to 60 (or 20 to 50) weight percent diluent oil. The presence of intentionally added water is not required for this simultaneous reaction, and it may be conducted in the absence of water. This simultaneous reaction may be represented by the following reaction scheme:

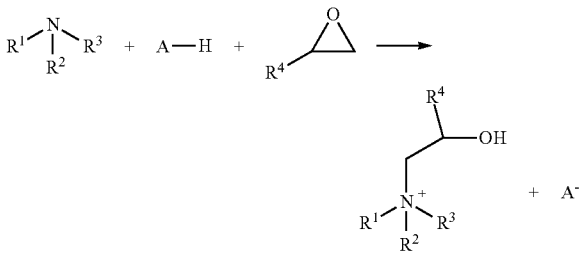

where $R^1$, $R^2$, $R^3$ and $R^4$ are hydrocarbyl groups or substituted hydrocarbyl groups as elsewhere described, and A-H represents an acidic organic compound that serves as the detergent substrate.

In order to effect reaction, it may be desirable to heat the reaction mixture, often in a sealed vessel, to an elevated temperature, such as at least 40 or 50° C., e.g., 60-150° C. or 70 to 130° C. or 80-110° C. or 80 to 100° C. for an appropriate period of time such as 15 minutes to 3 hours or 30 minutes to 2 hours or 45 minutes to 1.5 hours. The reaction product may be worked up by conventional means such as vacuum stripping. The product so obtained may be used as is, as a substantially neutral detergent, or it may be treated with excess base, either a metallic base or quaternary ammonium or phosphonium compound, as described above, and, optionally, further with an oxo acid, as described above.

It is believed that detergents prepared by the above one-step process exhibit certain advantages compared with similar materials prepared by a two-step process of first reacting the amine with the epoxide and subsequently reacting with the acidic organic compound. In addition to the simplicity of the process, it is believed that a more complete reaction ensues, fewer byproducts are formed, and a more favorable TBN:TAN ratio is typically obtained, Alternatively, in any of the foregoing embodiments and processes, the mixture may be further reacted with an oxo acid such as carbon dioxide to facilitate the incorporation of additional basicity.

In any of the above-described synthetic methods, additional basicity may be introduced, if desired, by means of addition of a basic metal compound in addition to the basic quaternary pnictogen compound. Any treatment with the oxo compound may be used to facilitate the incorporation of either the metal basicity or the quaternary pnictogen basicity, or both.

The detergents described herein may be profitably used in a lubricant formulation. A prominent component of lubricant formulations is typically an oil of lubricating viscosity. The base oil used in the inventive lubricating oil composition may be selected from any of the base oils in Groups I-V as specified in the American Petroleum Institute (API) Base Oil Interchangeability Guidelines. The five base oil groups are as follows: Group I: >0.03% sulfur and/or <90% saturates and viscosity index 80 to 120; Group II: ≤0.03% S and ≥90% saturates and VI 80 to 120; Group III: ≤0.03% S and ≥90% saturates and VI>120; Group IV: all polyalphaolefins; Group V: all others. Groups I, II and III are mineral oil base stocks. The oil of lubricating viscosity, then, can include natural or synthetic lubricating oils and mixtures thereof.

Natural oils include animal oils and vegetable oils as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity. Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, alkylated diphenyl ethers and alkylated diphenyl sulfides and their derivatives, analogs and homologues. Alkylene oxide polymers and interpolymers and derivatives thereof, and those where terminal hydroxyl groups have been modified by, for example, esterification or etherification, constitute other classes of synthetic lubricating oils. Another suitable class of synthetic lubricating oils that can be used comprises the esters of dicarboxylic acids and those made from C5 to C12 monocarboxylic acids and polyols or polyol ethers. Other synthetic lubricating oils include liquid esters of phosphorus-containing acids, polymeric tetrahydrofurans, and silicon-based oils. Hydrotreated naphthenic oils are also known. Synthetic oils may be used, such as those produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the present detergents in a lubricant may be 0.1 to 10 percent by weight, or 0.9 to 6 or 1.3 to 4 or 1.5 to 3 percent by weight. The detergents may also be supplied in the form of a concentrate in which a relatively larger amount of the detergent is provided in an oil medium, to be mixed with further components and further oil to form the final lubricant. The amount of the detergent in a concentrate may be 5 to 50 percent by weight or 12 to 35 or 26 to 28 or 28 to 24 percent by weight. The amount of the detergent of the present technology may also be present in a lubricant in an amount suitable to provide at least 0.1 TBN to the lubricant, alternatively, 0.1 to 20 TBN or 0.2 to 10 TBN or 0.5 to 5 or 1 to 3 TBN.

The lubricant as a whole may be a low or very low ash lubricant, having a sulfated ash level (ASTM D 874) of 0.01 to 1.5%, or 0.01 to 1.0%, or 0.05 to 1% or 0.1 to 0.5%. Typically the ash, or much or most of the ash, in the lubricant may be provided by components other than the detergents of the present technology. In certain embodiments, the lubricant has a sulfated ash level of less than 1.0% and a TBN (ASTM D 2896, from all sources) of at least 7 or 8 or 9 or 10 or 12.

Additional conventional components may be used in preparing a lubricant according to the present invention, for instance, those additives typically employed in a crankcase lubricant. Crankcase lubricants may contain any or all of the following components hereinafter described.

Another additive is a dispersant. Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, also known as succinimide dispersants. Succinimide dispersants are more fully described in U.S. Pat. Nos. 4,234,435, 6,077,909 and 3,172,892 and in EP 0 355 895. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. The amount of dispersant in the present composition can typically be 1 to 10 weight percent, or 1.5 to 9.0 percent, or 2.0 to 8.0 percent, all expressed on an oil-free basis.

Another component is an antioxidant. Antioxidants encompass phenolic antioxidants, which may comprise a butyl substituted phenol containing 2 or 3 t-butyl groups. The para position may also be occupied by a hydrocarbyl group or a group bridging two aromatic rings. The latter antioxidants are described in greater detail in U.S. Pat. No. 6,559,105. Antioxidants also include aromatic amine, such as nonylated diphenylamines. Other antioxidants include sulfurized olefins, titanium compounds, and molybdenum compounds. U.S. Pat. No. 4,285,822, for instance, discloses lubricating oil compositions containing a molybdenum and sulfur containing composition. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

Viscosity improvers (also sometimes referred to as viscosity index improvers or viscosity modifiers) may be included in the compositions of this invention. Viscosity improvers are usually polymers, including polyisobutenes, polymethacrylic acid esters, hydrogenated diene polymers, polyalkylstyrenes, esterified styrene-maleic anhydride copolymers, hydrogenated alkenylarene-conjugated diene copolymers, and polyolefins. Multifunctional viscosity improvers, which also have dispersant and/or antioxidancy properties are known and may optionally be used.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent phosphorus. Often the antiwear agent is a zinc dialkyldithiophosphate (ZDP). For a typical ZDP, which may contain 11 percent P (calculated on an oil free basis), suitable amounts may include 0.09 to 0.82 percent. Non-phosphorus-containing anti-wear agents include borate esters (including borated epoxides), dithiocarbamate compounds, molybdenum-containing compounds, tartrate esters, tartrimides, and sulfurized olefins.

Other additives that may optionally be used in lubricating oils include pour point depressing agents, extreme pressure agents, anti-wear agents, color stabilizers, friction modifiers, seal swell agents, corrosion inhibitors, and antifoam agents. One or more metal-containing detergents, as described above, may also be included in any of the formulations.

The lubricant described herein may be used to lubricate a mechanical device, by supplying the lubricant to the device, and in particular to its moving parts. The device may be an internal combustion engine, a driveline component (e.g., automatic or manual transmission, gear box, differential). The internal combustion engines that may be lubricated may include gasoline fueled engines, spark ignited engines, diesel engines, compression ignited engines, two-stroke cycle engines, four-stroke cycle engines, sump-lubricated engines, fuel-lubricated engines, natural gas-fueled engines, marine diesel engines, and stationary engines. The vehicles in which such engines may be employed include automobiles, trucks, off-road vehicles, marine vehicles, motorcycles, all-terrain vehicles, and snowmobiles. In one embodiment, the lubricated engine is a heavy duty diesel engine, which may include sump-lubricated, two- or four-stroke cycle engines, which are well known to those skilled in the art.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed description is found in WO2008/147704, paragraphs 0118-0119.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Quaternary Ammonium Sulfonate Detergents

Example 1a: Tetra-n-Butylammonium Sulfonate Detergent (Base Ratio 2)

1) Diluent oil (18.6 g) and tetra-n-butyl ammonium hydroxide ("TNBAH," 129.5 g of a 40% solution in methanol; 0.20 mol) are stirred under nitrogen. A long-chain alkylbenzenesulfonic acid (50.3 g; 0.10 mol, in 5% oil) is slowly added over to give a brown colloidal suspension. The reaction mixture is heated with stirring to 70-75° C. for 60 minutes under nitrogen.

2) Thereafter, the reaction is heated to 90-110° C. under nitrogen for 60 minutes to remove volatiles. The reaction mixture is subsequently placed under vacuum (<5.3 kPa (<40 mmHg)) for 15-30 minutes.

3) Final product is isolated using a steam jacketed funnel and filter.

4) 91 g of product containing 17.8% oil is isolated, having a measured TBN of 80 and TAN of 1.2 (each measured on the oil-containing product).

Example 1b: Tetra-n-Butylammonium Sulfonate Detergent (Base Ratio 3)

1) Example 1a, item 1, is substantially repeated except 194.3 g (0.30 moles) of the TNBAH is used.

2) See Example 1a item 2.

3) See Example 1a item 3.

4) 145 g of product containing 14.5% oil is isolated, TBN: 121; TAN: 0.7.

Example 1c: Tetra-n-Butylammonium Sulfonate/Carbonate Detergent (Base Ratio 2)

1) Diluent oil (18.6 g) and TNBAH (194.3 g of a 40% solution in methanol; 0.30 mol) are mixed with 5.03 g (0.10 moles) alkylbenzenesulfonic acid substantially as in Example 1a, step 1. The mixture is heated with stirring to 60° C.

2) Carbon dioxide is administered (above surface at 14-20 L/hr (0.5-0.7 cfh)) for 60 minutes at 60° C.

3) See item 2 in Example 1a.

4) See item 3 in Example 1a.

5) 123 g of product containing 17.1% oil is isolated, TBN 86, TAN 0.6.

Example 1d: Tetra-n-Butylammonium Sulfonate/Succinate Detergent (Base Ratio 2)

1) Example 1c, part 1, is substantially repeated except that 5.9 g succinic acid is added along with the alkylbenzenesulfonic acid.

2) See item 2 in Example 1a.

3) See item 3 in Example 1a.

4) 98 g of product containing 17.1% oil is isolated. TBN 83, TAN 3.4.

Quaternary Ammonium Phenate Detergents

Example 2a: Tetra-n-Butylammonium Phenolate (C16-18)/Carbonate Detergent (Base Ratio 10)

1) Diluent oil (20 g), ethylene glycol (5 g), mixed C4 and C5 alcohols (15 g), C16-18 alkyl phenol (6.64 g; 0.02 mol) and TNBAH (167 g of a 31% solution in methanol; 0.20 mol actives) are stirred at 50° C. under nitrogen for 60 minutes. Water (9 g) is added with stirring for an additional 10 minutes.

2) See item 2 in Example 1c

3) See item 2 in Example 1a.

4) See item 3 in Example 1a.

5) 77 g of product containing 22.0% oil is isolated. TBN 94, TAN 0.

Example 2b: Tetra-n-Butylammonium Phenolate (C16-18)/Carbonate Detergent (Base Ratio 2)

1) Example 2a, item 1, is substantially repeated except that the amount of the C16-16 alkyl phenol is 33.2 g (0.10 mol) and the amount of the TNBAH solution is 130 g (40% solution, 0.20 mol).

2) See item 2 in Example 1c

3) See item 2 in Example 1a.

4) See item 3 in Example 1a.

5) 113 g of product containing 17.8% oil is isolated. TBN 76, TAN 0.

Example 2c: Tetra-n-Butylammonium Phenolate (C7)/Carbonate Detergent (Base Ratio 2)

1) Example 2a, item 1, is substantially repeated except that the phenol employed is 24.8 g (0.10 mol) C7 alkyl phenol and the amount of TNBAH is 130 g (40% solution, 0.20 mol).

2) See item 2) in Example 1c

3) See item 2) in Example 1a.

4) Hot liquid is decanted from any settled solid material.

5) 103 g of product containing 19.2% oil is isolated. TBN: 93; TAN: 0.

Example 2d: Tetra-n-Butylammonium Phenolate (C39) Detergent (Base Ratio 1)

1) Diluent oil (10 g), C39 alkyl phenol (68.1 g; 0.10 mol), methanol (50 g) and TNBAH (65 g of a 40% solution in Methanol; 0.10 mol) are stirred at 65° C. for 60 minutes under nitrogen.

2) See item 2 in Example 1a.
3) See item 3 in Example 1a.
4) 66 g of product containing 9.8% oil is isolated. TBN: 55; TAN: 0.

Example 2e: Tetra-n-Butylammonium Phenolate (C39)/Succinate Detergent (Base Ratio 2)

1) Diluent oil (10 g), C39 alkyl phenol (68.1 g; 0.10 mol), succinic acid (5.9 g; 0.05 mol) and TNBAH (129.5 g of a 40% solution in methanol; 0.20 mol) are stirred at 65° C. for 210 minutes under nitrogen.
2) See item 2 in Example 1a.
3) See item 3 in Example 1a.
4) 123 g of product containing 7.6% oil is isolated. TBN: 56; TAN: 0.

Example 2f: Tetra-n-Butylammonium Phenolate (C39)/Carbonate Detergent (Base Ratio 2)

1) Diluent oil (10 g), C39 alkyl phenol (68.1 g; 0.10 mol) water (5 g), mixed C4 and C5 alcohols (5 g) and TNBAH (129.5 g of a 40% solution in methanol; 0.2 mol) are stirred at 65° C. for 60 minutes under nitrogen.
2) See item 2 in Example 1c.
3) See item 2 in Example 1a.
4) See item 3 in Example 1a.
5) 107 g product containing 8.2% oil is isolated. TBN: 62; TAN: 4.6.

Quaternary Ammonium Stearate Detergents

Example 3a: Tetra-n-Butylammonium Iso-Stearate/Carbonate Detergent (Base Ratio 2)

1) Diluent oil (20 g), water (18 g), mixed C4 and C5 alcohols (15 g) and isostearic acid (28.6 g) and TNBAH (130 g of a 40% solution in methanol; 0.20 mol) are stirred at 50° C. for 60 minutes under nitrogen.
2) See item 2) in Example 1c.
3) See item 2) in Example 1a.
4) Decanting some solids from product affords oil, free from particulates.
5) 100 g product containing 19.4% oil is isolated. TBN: 95; TAN: 2.1.

Example 3b: Tetra-n-Butylammonium Isostearate/Carbonate Detergent (Base Ratio 5)

1) Diluent oil (20 g), water (18 g), mixed C4 and C5 alcohols (15 g), ethylene glycol (5 g) isostearic acid (11.4 g) and TNBAH (130 g of a 40% solution in methanol; 0.20 mol) are stirred at 50° C. for 60 minutes under nitrogen.
2) See item 2 in Example 1c.
3) See item 2 in Example 1a.
4) Upon cooling, freely flowing oil is obtained.
5) 86 g product containing 21.1% oil is obtained. TBN: 111; TAN: 1.2.

Quaternary Ammonium Salixarate Detergent

Example 4: Tetra-n-Butylammonium Salixarate (C16-18) Detergent (Base Ratio 4)

1) Mixed C4-C5 (15 g), C16-18 alkyl salixarene (46.8 g; 0.10 mol; containing 18.6% oil) and TNBAH (332 g of a 1.0 M solution in methanol; 0.40 mol) are stirred at 70° C. for 120 minutes under nitrogen. (The salixarene is a mixture of materials prepared by the formaldehyde coupling of 2 moles of C16-18 alkyl phenol with 1 mole of salicylic acid.)
2) See item 2 in Example 1a.
3) 103 g product containing 6.2% oil is obtained without further purification. TBN: 188; TAN: 0.

Quaternary Ammonium Calixarate Detergent

Example 5: Tetra-n-Butylammonium Calixarate (C16-18) Detergent (Base Ratio 1)

1) Mixed C4-C5 alcohols (15 g), C16-18 alkyl calixarene (104 g; 0.20 mol) and TNBAH (129.5 g of a 40% solution in methanol; 0.20 mol) are stirred at 70° C. for 120 minutes under nitrogen. (The calixarene is a mixture of materials prepared by the formaldehyde coupling of C12 alkyl phenol. It is believed that the calixarene mixture contains cyclic structures of about 6-8 or more alkylphenol units. Such materials are described in EP 0 755 998.)
2) See item 2) in Example 1a.
3) 152 g product containing 34.2% oil is obtained without further purification. TBN: 76; TAN: 0.

Quaternary Ammonium Salicylate Detergents

Example 6a: Tetramethylammonium Salicylate (C14-18) Detergent (Base Ratio 1)

1) Alkyl(C14-18)salicylic acid (142.4 g; 0.15 mol) in toluene, diluent oil (9.3 g), methanol (15 g) and tetramethylammonium hydroxide pentahydrate (27.2 g; 0.15 mol) are stirred at 60° C. for 60 minutes under nitrogen.
2) See item 2 in Example 1a.
3) 74 g product containing 12.5% oil is obtained without further purification. TBN: 98; TAN: 1.

Example 6b: Tetraethylammonium Salicylate (C14-18) Detergent (Base Ratio 1)

1) Alkyl(C14-18)salicylic acid (67.1 g; 0.10 mol), in oil (21%) and tetraethylammonium hydroxide (58.8 g of a 25% solution in methanol; 0.10 mol) are stirred at 65° C. for 60 minutes under nitrogen.
2) See item 2) in Example 1a.
3) 80 g product containing 18.1% oil is obtained without further purification. TBN: 69; TAN: 2.4.

Example 6c: Tetraethylammonium Salicylate (C14-18) Detergent (Base Ratio 2)

1) Example 6a, step 1, is substantially repeated except that the amount of tetraethylammonium hydroxide is 117.6 g of a 25% solution; 0.20 mol.
2) See item 2 in Example 1a.
3) See item 3 in Example 1a.
4) 83 g product containing 15.3% oil is obtained. TBN: 86; TAN: 0.

Example 6d: Benzyltrimethylammonium Salicylate (C14-18) Detergent (Base Ratio 1)

1) Alkylsalicylic acid (C14-18) (67.1 g; 0.10 mol) in oil (21%) and benzyltrimethylammonium hydroxide (41.8 g of a 40% solution in methanol; 0.10 mol actives) are stirred at 65° C. for 90 minutes.
2) See item 2 in Example 1a.
3) See item 3 in Example 1a.

4) 76 g product containing 17.7% oil is obtained. TBN: 67; TAN: 0.

Example 6e: Tetra-n-Butylammonium Salicylate (C14-18) Detergent (Base Ratio 1)

1) Alkyl(C14-18)salicylic acid (67.1 g; 0.10 mol) in oil (21%) and TNBAH (64.8 g of a 40% solution in methanol; 0.10 mol) are stirred at 65° C. for 60 minutes under nitrogen.
2) See item 2 in Example 1a.
3) See item 3 in Example 1a.
4) 83 g product containing 15.9% oil is obtained. TBN: 66; TAN: 0.8.

Example 6f: Tetra-n-Butylammonium Salicylate (C14-18) Detergent (Base Ratio 2)

1) Example 6e, step 1 is substantially repeated except that the amount of the TNBAH solution is 129.5 g (0.20 mol).
2) See item 2 in Example 1a.
3) See item 3 in Example 1a.
4) 122 g product containing 19.3% oil is obtained. TBN: 82; TAN: 0.1.

Example 6g: Tetra-n-Butylammonium Salicylate (C14-18) Detergent (Base Ratio 3)

1) Alkyl(C14-18)salicylic acid (60 g; 0.09 mol) in oil (21%) and TNBAH (173.7 g of a 40% solution in methanol; 0.27 mol) are stirred at 70-75° C. for 90 minutes under nitrogen.
2) See item 2 in Example 1a.
3) See item 3 in Example 1a.
4) 128 g product containing 10.2% oil is obtained. TBN: 111; TAN: 0.

Example 6h: Tetra-n-Butylammonium Salicylate (C14-18)/Borate Ester Detergent (Base Ratio 2)

1) Alkyl(C14-18)salicylic acid (60 g; 0.09 mol) in oil (21%), 2-ethylhexyl-borate ester (39.8 g; 0.10 mol) and TNBAH (115.3 g of a 40% solution in methanol; 0.18 mol) are stirred at 70-75° C. for 90 minutes under nitrogen.
2) See item 2 in Example 1a.
3) See item 3 in Example 1a.
4) 131 g product containing 9.0% oil is obtained. TBN: 69; TAN: 0.

Example 6i: Tetra-n-Butylammonium Salicylate (C14-18)/Tartrate Detergent (Base Ratio 2)

1) Alkyl(C14-18)salicylic acid (56.2 g; 0.10 mol) in oil (18%), water (5 g), tartaric acid (7.5 g; 0.05 mol) and TNBAH (129.5 g of a 40% solution in methanol; 0.20 mol) are stirred at 70-75° C. for 60 minutes under nitrogen.
2) See item 2 in Example 1a.
3) See item 3 in Example 1a.
4) 91 g product containing 9.1% oil is obtained. TBN: 94; TAN: 8.5.

Example 6j: Tetra-n-Butylammonium Salicylate (C14-18)/Acetylacetonate Detergent (Base Ratio 2)

1) Alkyl(C14-18)salicylic acid (56.2 g; 0.10 mol) in oil (18%), acetylacetone (10 g; 0.10 mol) and TNBAH (129.5 g of a 40% solution in methanol; 0.20 mol) are stirred at 70-75° C. for 60 minutes under nitrogen.
2) See item 2) in Example 1a.
3) See item 3 in Example 1a.
4) 81 g product containing 8.9% oil is obtained. TBN: 105; TAN: 9.7

Quaternary Ammonium Succinate Detergents

Example 7a: Tetra-n-Butylammonium Succinate (C12)/Carbonate Detergent (Base Ratio 3)

1) Diluent oil (20 g), water (9 g) and dodecylsuccinic anhydride (15.6 g) are stirred at room temperature under nitrogen for 1 hr ensuring hydrolysis of the succinic anhydride.
2) TNBAH (40% solution in methanol, 130 g; 0.20 mol), ethylene glycol (5 g) and mixed C4 and C5 alcohols (15 g) are added and the mixture is stirred at 50° C. for 60 minutes under nitrogen.
3) See item 2 in Example 1c.
4) See item 2 in Example 1a.
5) The mixture is filtered to obtain 72 g of a brown oil containing 20.6% oil. TBN: 101; TAN: 9.3.

Example 7b: Tetra-n-Butylammonium Succinate (C16)/Carbonate Detergent (Base Ratio 2)

1) Diluent oil (20 g), water (36 g) and hexadecenylsuccinic anhydride (30.0 g) are stirred at (50° C.) under nitrogen for 30 minutes ensuring hydrolysis of the succinic anhydride.
2) TNBAH (40% solution in methanol, 130 g; 0.20 mol), and mixed C4 and C5 alcohols (15 g) are added and the mixture is stirred at 50° C. for 60 minutes under nitrogen.
3) See item 2 in Example 1c.
4) See item 2 in Example 1a.
5) 105 g product containing 21.8% oil is obtained. TBN: 97; TAN: 6.1.

Example 7c: Tetra-n-Butylammonium Succinate (C39) Neutral Detergent (Base Ratio 1)

1) Diluent oil (10 g), water (18 g), methanol (30 g) and polyisobutene-substituted succinic anhydride (63.2 g; 0.05 mol) are stirred and heated (65° C.) under nitrogen for 60 minutes to ensure hydrolysis of the succinic anhydride.
2) TNBAH (65 g of a 40% solution in Methanol; 0.10 mol) is added and the mixture is heated and stirred at 65° C. for 60 minutes under nitrogen.
3) See item 2 in Example 1a.
4) See item 3 in Example 1a.
5) 56 g product containing 10.2% oil is obtained. TBN: 60; TAN: 0.

Example 7d: Tetra-n-Butylammonium Succinate (C39) Detergent (Base Ratio 2)

1) Step 1 of Example 7c is substantially repeated.
2) TNBAH (129.5 g of a 40% solution in methanol; 0.20 mol) is added and the mixture heated as in Example 7c.
3) See item 2 in Example 1a.
4) See item 3 in Example 1a.
5) 65 g product containing 8.1% oil is obtained. TBN: 85; TAN: 0.

Example 7e: Tetra-n-Butylammonium Succinate (C39)/Carbonate Detergent (Base Ratio 2)

1) Steps 1 and 2 of Example 7c are substantially repeated
2) See item 2 in Example 1c.

3) See item 2 in Example 1a.

4) See item 3 in Example 1a.

5) 128 g product containing 7.8% oil is obtained. TBN: 88; TAN: 3.9.

Quaternary Imidazolium or Pyridinium Detergents

Example 8: Imidazolium Phenolate (C16-18) Detergent (Base Ratio 1)

1) Aqueous sodium hydroxide (8.0 g; 0.20 mol) in water (50 g) is added to diluent oil (10 g), mixed C4 and C5 alcohols (25 g) and C16-18 alkyl phenol (33.2 g; 0.10 mol) mixture and the reaction heated at 60° C. for 60 minutes under nitrogen.

2) 1-butyl-3-methylimidazolium chloride (17.5 g; 0.10 mol) is added and the reaction mixture stirred at the above conditions for an additional 120 minutes.

3) The resultant organic layer is separated from the aqueous layer and the organic layer is heated (100-110° C.) for 30 minutes under nitrogen and then placed under vacuum (ca. 2.7 kPa (20 mmHg)) at the same temperature to remove remaining traces of volatile components.

4) 51 g product containing 28.3% oil is obtained. TBN: 61; TAN: 0.

Example 9: Imidazolium Salicylate (C14-16) Detergent (Base Ratio 2)

1) Aqueous sodium hydroxide (8.0 g; 0.20 mol) in water (25 g) is added to diluent oil (20 g), mixed C4 and C5 alcohols (25 g), water (36 g) and alkyl(C14-16)salicylic acid (44.0 g; 0.10 mol). The reaction mixture is heated and stirred at (75° C. for 30 minutes under nitrogen.

2) To this mixture, 1-butyl-3-methylimidazolium chloride (34.9 g; 0.20 mol) is added and the reaction mixture stirred for an additional 120 minutes.

3) See item 3 in Example 8.

4) 57 g product containing 29.6% oil is obtained. TBN: 101; TAN: 3.7.

Example 10: Cetylpyridinium Salicylate (C14-16) Detergent (Base Ratio 1)

1) Aqueous sodium hydroxide (6 g; 0.15 mol) in water (10 g) is added to a toluene (30 g), mixed C4 and C5 alcohols (30 g), water (36 g) and alkyl(C14-16) salicylate (44.0 g; 0.10 mol). The reaction mixture is heated, with stirring, to 75° C. for 30 minutes under nitrogen.

2) To this mixture, cetylpyridinium chloride (38.8 g; 0.10 mol) is added and the reaction mixture stirred for a further 120 minutes.

3) See item 3) in Example 8.

4) 50 g product containing 0% oil is obtained. TBN: 84; TAN: 0.

Example 11

A formulation is prepared containing 1.9 percent of a product similar to that of Example 6f, above, except that the amount of diluent oil is somewhat different. The formulation is compared, in the table below, against the same formulation that does not contain the material of the present invention.

| | Example 11 | Comparative Ex. 1 |
|---|---|---|
| Component, % | | |
| Oils (API Group II) | 87.0 | 88.9 |
| Quaternary ammonium salicylate (9.6% oil) | 1.9 | — |
| Viscosity modifier, olefin copolymer | 6.1 | 6.1 |
| Pour point depressant | 0.2 | 0.2 |
| Succinimide dispersant (incl. 50% oil) | 6.2 | 6.2 |
| Ca sulfonate detergents (~44% oil) | 1.61 | 1.61 |
| Ca phenate detergents (~34% oil) | 1.22 | 1.22 |
| Zinc dialkyl dithiophosphate (9% oil) | 0.88 | 0.88 |
| Antioxidants | 1.04 | 1.04 |
| Other conventional components | 0.12 | 0.12 |
| Analysis: | | |
| Ca content of composition | 0.230 | 0.228 |
| Zn content | 0.104 | 0.106 |
| % Sulfated Ash (ASTM D 874) | 0.94 | 0.97 |
| TBN (ASTM D 2896) | 10.0 | 7.7 |
| TBN (ASTM D 4739) | | |
| Buffer Point | 8.8 | 6.3 |
| Inflection Point | 9.3 | 6.8 |

It is evident from the table that the presence of the quaternary ammonium detergent serves to desirably increase the TBN of the lubricant composition, without imparting additional metals or sulfated ash to the lubricant.

Example 12

A one-step reaction. A flask is charged with 1,4-diazabicylo[2.2.2]octane (11.2 g; 0.10 mol) and alkylsalicylic acid (48.4 g, oil-containing, 0.10 mol) to which propylene oxide (11.6 g, 0.20 mol) is added dropwise at room temperature with stirring over 15 minutes. The reaction mixture is stirred for an additional 15 minutes at room temperature and heated to 50° C. for 120 minutes, and then to 80-110° C. under nitrogen for 60 minutes, before being subjected to vacuum (<5.3 kPa, 40 mm Hg) for 15 minutes. 56 g of product containing 12.5% oil is isolated, having TBN of 166 and TAN of 6.2.

Example 13

A one-step reaction. Example 12 is substantially repeated except that in place of the diazabicylooctane there is used 1,8-diazabicylo[5.4.0]undec-7-ene (15.2 g, 0.10 mol). 60 g of product containing 11.8% oil is isolated, having TBN of 83 and TAN of 0.

Examples 14-33

Except as noted, each of the following materials is charged to a Parr bomb, heated to 80-100° C. for 1-3 hours and then cooled to room temperature. In each instance the tertiary amine is as shown in the table below; the alkylene oxide is propylene oxide, and the organic acid is a (A) hydrocarbyl-substituted salicylic acid or (B) an alkylbenzene sulfonic acid.

| Ex | Tertiary amine | Acid | Stoichiometry[a] | % Yield | TBN | TAN |
|---|---|---|---|---|---|---|
| 14 | 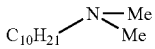 | A | 1.0:2.0:1.0 | 96 | 66 | 0 |
| 15 | 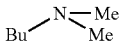 | A | 1.0:1.2:1.0 | 95 | 73 | 1 |
| 16 | 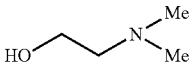 | A | 1.0:1.2:1.0 | 92 | 77 | 0 |
| 17 | 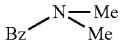 | A | 1.0:1.2:1.0 | 96 | 72 | 0 |
| 18 | 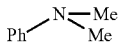 | A | 1.0:1.2:1.0 | 95 | 74 | 1 |
| 19 | 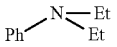 | A | 1.0:1.2:1.0 | 97 | 70 | 9 |
| 20 | 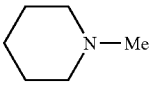 | A | 1.0:2.0:1.0 | 94 | 73 | 0 |
| 21 | | A | 1.0:1.1:1.0 | 94 | 77 | 2 |
| 22 | 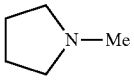 | A | 1.0:1.2:1.0 | 87 | 77 | 0 |
| 23 | 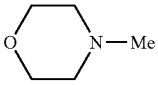 | A | 1.0:1.2:1.0 | 94 | 76 | 0 |
| 24 | 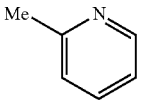 | A | 1.0:1.2:1.0 | 95 | 72 | 2 |
| 25 | 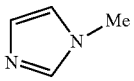 | A | 1.0:1.2:1.0 | 89 | 77 | 0 |
| 26 | 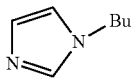 | A | 1.0:1.2:1.0 | 97 | 73 | 2 |
| 27 | 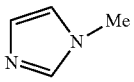 | B | 1.0:4.0:1.0 | 96 | 52 | 5 |
| 28 | 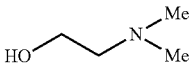 | B | 1.0:4.0:1.0 | 96 | 55 | 0 |
| 29 | 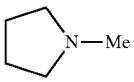 | B | 1.0:4.0:1.0 | 96 | 62 | 0 |
| 30 | 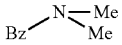 | B | 1.0:4.0:1.0 | 93 | 60 | 0 |
| 31[b] | 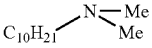 | B | 1.0:4.0:1.0 | 63 | 65 | 40 |
| 32 | 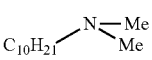 | B | 1.0:4.0:1.0 | 93 | 55 | 0 |

-continued

| Ex | Tertiary amine | Acid | Stoichiometry[a] | % Yield | TBN | TAN |
|---|---|---|---|---|---|---|
| 33 | 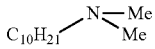 | B | 1.0:1.5:1.0 | 96 | 57 | 8 |

[a]equivalent ratio amine:alkylene oxide:organic acid

[b]A reference example: prepared by a two step process in which the amine, propylene oxide, and acetic acid are charged to the Parr bomb and reacted, then subsequently reacted with the sulfonic acid. The reported product is believed to be contaminated with a significant amount of tertiary amine salt.

Bz: benzyl

Ph: phenyl

Example 34

General synthesis of quaternary ammonium salt from dimethyl carbonate. A Parr bomb is charged with 1.0 equivalents of a tertiary amine, 1.0 equivalents of dimethylcarbonate, and methanol solvent (about 4.8 equivalents). The mixture is sealed and heated to 120° C. for 2 hours before being cooled to room temperature. The volatiles are removed by vacuum and the product isolated.

Example 35

General synthesis of quaternary ammonium salt from dibenzyl carbonate. A flask is charged with dibenzylcarbonate (75 g, 0.30 mol, 1 equivalent) and a tertiary amine (0.60 mol, 2 equivalents) and heated at 100-130° C. for 24-72 hours. Thereafter the reaction mixture is subjected to vacuum (<0.3 kPa, <2 mm Hg) and heating (100-130° C.) for 1 hour and the product is isolated.

Example 36

General synthesis of quaternary ammonium salt from benzyl chloride. A flask is charged with water (91 g, 5 mol), methanol (32 g, 1 mol), benzyl chloride (127 g, 1 mole) and a tertiary amine (1 mole). An exothermic reaction is observed. After the reaction mixture has cooled to room temperature, the volatiles are removed by vacuum and the products isolated.

Example 37

General detergent synthesis by carbonate anion metathesis, from benzyl carbonate. A flask is charged with the quaternary ammonium carbonate prepared generally as in Example 35 (0.106 equivalents) and heated to 80° C., to which a detergent acid (e.g., a C16-18 alkyl salicylic acid, 0.100 equivalents, containing diluent oil) is added dropwise with stirring, over the course of 1 hour. The mixture is stirred for an additional 30 minutes, then heated to 130° C. under nitrogen for 30 minutes and subjected to vacuum (<0.3 kPa, <2 mm Hg) for 30 minutes. The product obtained typically will contain 5-10% diluent oil.

Example 38

General detergent synthesis by carbonate anion metathesis, from methyl carbonate. A flask is charged with the quaternary ammonium carbonate prepared generally as in Example 34 (1.0-2.0 equivalents) and heated to 80° C., to which a detergent acid (e.g., a C16-18 alkyl salicylic acid, 1.0 equivalents, containing diluent oil) is added dropwise with stirring, over the course of 30 minutes. The mixture is stirred for an additional 30 minutes, then heated to 100° C. under nitrogen for 30 minutes, to isolate a product containing 5 to 10% oil.

Example 39

General detergent synthesis by chloride-based anion metathesis. A flask is charged with the detergent acid (e.g. a C16-18 alkyl salicylic acid, 1.0 equivalents, containing diluent oil) and toluene (7.4 eq), to which a solution of sodium hydroxide (1.0 equivalents) in water (4.5 eq.) is added dropwise with stirring over 30 minutes. Thereafter the mixture is heated to 75° C. and a trihydrocarbylammonium chloride prepared generally as in Example 36 (1.1 equivalent) is added and the mixture stirred for 1 hour. Stirring is discontinued and the mixture typically separates into two layers, and the aqueous layer is removed. Additional water is added and the mixture is stirred at 75° C. and the aqueous phase separated. The washing procedure may be repeated, for example, up to 3 times. Thereafter, the mixture is heated to 130° C. under nitrogen and subjected to vacuum (<7 kPa, <50 mm Hg) for 30 minutes, to isolate a product containing 5-10% oil.

Examples 40-57

Quaternary ammonium detergents are prepared using the general techniques of Examples 34 through 39 as shown in the following Table:

| Ex | Cation | Anion[a] | Base Ratio | Prep Method of Ex.: | Yield | TBN | TAN |
|---|---|---|---|---|---|---|---|
| 40 | | B | 1.06 | 37 | 100 | 90.9 | 0 |
| 41 | 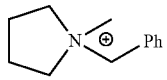 | A | 1.05 | 37 | 100 | 75.9 | 0.17 |
| 42 | 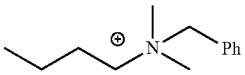 | B | 1.05 | 37 | 100 | 78.0 | 0 |
| 43 | | A | 1.05 | 37 | 99 | 68.2 | 1.98 |
| 44 | 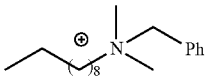 | B | 1.1 | 39[b] | 99 | 73.6 | 0.98 |
| 45 | | A | 1.1 | 39[b] | 84 | 66.2 | 2.33 |
| 46 | 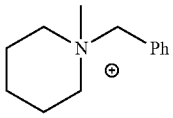 | B | 1.05 | 37 | 95 | 75.0 | 0.15 |
| 47 | | A | 1.05 | 37 | 100 | 66.3 | 0.32 |
| 48 | 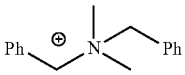 | B | 1.1 | 39 | 94 | 72.0 | 1.58 |
| 49 | | A | 1.1 | 39 | 88 | 70.2 | 0.74 |
| 50 | 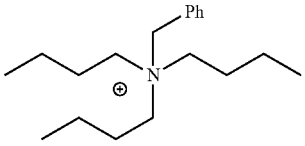 | B | 1.06 | 39 | 89 | 71.6 | 9.75 |
| 51 | | A | 1.0 | 39 | 96 | 68.8 | 3.81 |
| 52 | 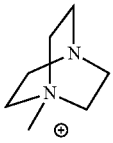 | A | 1.04 | 38 | 92 | 159 | 0.24 |
| 53 | | B | 1.0 | 38 | 92 | 77.2 | 4.51 |
| 54 | 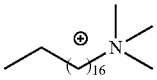 | A | 1.97 | 38 | 92 | 100.8 | 0.66 |

-continued

| Ex | Cation | Anion[a] | Base Ratio | Prep Method of Ex.: | Yield | TBN | TAN |
|---|---|---|---|---|---|---|---|
| 55 | 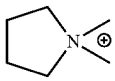 | A | 1.13 | 38 | 77 | 106.4 | 8.54 |
| 56 | | A | 1.74 | 38 | 96 | 118.7 | 9.81 |
| 57 | 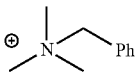 | A | 2.0 | 39 | 77 | 122 | 12.25 |

[a]Anion A: from hydrocarbyl salicylic acid
Anion B: from alkylbenzene sulfonic acid
[b]also prepared by the method of example 37
Ph: phenyl Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A composition comprising an oil-soluble ionic detergent, which detergent comprises (a) a quaternary ammonium cation and (b) an organic anion having at least one aliphatic hydrocarbyl group of sufficient length to impart oil solubility to the detergent;

said oil-soluble ionic detergent having a total base number (TBN) to total acid number (TAN) ratio of at least 2:1;

wherein said oil-soluble ionic detergent exhibits a TBN of at least about 10 arising from a non-metallic base;

wherein said oil-soluble ionic detergent comprises a stoichiometric excess of quaternary ammonium cations of (a) over organic anions of (b) such that said cations and anions are present in an equivalent ratio (a):(b) of at least about 2:1; and wherein the overbased detergent further comprises an additional oxo-anion which comprises a carbonate, bicarbonate, or hydroxide ion;

wherein the cation comprises four groups selected from the group consisting of methyl groups, ethyl groups, propyl groups, butyl groups, benzyl groups, phenyl groups, hydroxyalkyl groups, aminoalkyl groups, and mixtures thereof.

2. The composition of claim 1 wherein the oil-soluble ionic detergent comprises a sulfonate, carboxylate, or phenate anion.

3. The composition of claim 1 wherein the oil-soluble ionic detergent has a TBN of about 50 to about 300 and a TAN of less than 10.

4. The composition of claim 1 wherein the oil-soluble detergent has a TBN:TAN ratio of about 7:1 to about 150:1.

5. The composition of claim 1 wherein the oil-soluble ionic detergent does not contribute metal ions to the composition.

6. A lubricant composition comprising an oil of lubricating viscosity and the oil-soluble ionic detergent of claim 1.

7. The lubricant of claim 6 wherein the amount of the oil-soluble ionic detergent is about 0.1 to about 10 percent by weight.

8. The lubricant of claim 6 further comprising at least one dispersant, metal-containing detergent other than said oil-soluble ionic detergent, extreme pressure agent, anti-wear agent, antioxidant, friction modifier, viscosity modifier, metal salt of a phosphorus acid, corrosion inhibitor, antirust agent, antifoam agent, or mixtures thereof.

9. The lubricant of claim 6 further comprising a metal-containing detergent other than said oil-soluble ionic detergent.

10. The lubricant of claim 6 wherein the oil-soluble ionic detergent is substantially metal-free and contributes at least about 0.2 TBN to the lubricant.

11. A method for lubricating a mechanical device, comprising supplying thereto the lubricant of claim 6.

* * * * *